United States Patent [19]

Eki

[11] 4,306,593

[45] Dec. 22, 1981

[54] LIQUID INFUSION NOZZLE APPARATUS AND METHOD USING THE SAME APPARATUS

[75] Inventor: Masakatu Eki, Hiroshima, Japan

[73] Assignee: Nihon Top Nozzle Kabushiki Kaisha, Hiroshima, Japan

[21] Appl. No.: 89,623

[22] Filed: Oct. 29, 1979

[30] Foreign Application Priority Data

Nov. 16, 1978 [JP] Japan ..... 53-140440
Nov. 16, 1978 [JP] Japan ..... 53-140441

[51] Int. Cl.[3] ..... B65B 3/06

[52] U.S. Cl. ..... 141/1; 141/293; 141/295; 141/296

[58] Field of Search ..... 141/4–6, 141/37, 39, 40, 286, 290, 291, 292, 295, 296, 301, 302, 353, 355, 357, 360–362, 369–372, 392, 1, 293

[56] References Cited

U.S. PATENT DOCUMENTS 1,216,574 2/1917 Kiefer ..... 141/296
2,679,347 5/1974 Franz ..... 141/295 X

FOREIGN PATENT DOCUMENTS 1025743 3/1956 Fed. Rep. of Germany ..... 141/360

*Primary Examiner*—Frederick R. Schmidt
*Attorney, Agent, or Firm*—Carroll F. Palmer

[57] ABSTRACT

A nozzle apparatus for infusing a liquid from a liquid reservoir into a vessel or bottle located lower than the reservoir. The nozzle apparatus comprising an outer cylindrical wall member having the interior communicated with the reservoir and filled with a liquid to be infused, an inner cylindrical wall member coaxially arranged in the interior of the outer cylindrical wall member for axial movement therein, a valve member adapted to close communication between the interiors of the outer and the inner cylindrical wall members, and an air-relief conduit member supported on the outer wall member and extending through the outer and the inner wall members and the valve member to terminate as a distal end which is adapted to be inserted in a vessel to be infused with a liquid. When the vessel is elevated by suitable means toward the nozzle apparatus, the vessel pushes the inner wall member upwards to a position allowing the valve to open for infusion of a liquid.

5 Claims, 4 Drawing Figures

LIQUID INFUSION NOZZLE APPARATUS AND METHOD USING THE SAME APPARATUS

BACKGROUND OF THE INVENTION

This invention relates to an apparatus and a method for automatically infusing a liquid, e.g. wine, juice, etc., into vessels or receptacles and particularly a method using a novel infusion nozzle apparatus capable of rapid infusion of a liquid into vessels.

A liquid infusion apparatus having been recently developed and known to me comprises, generally, a plurality of, say 6–12, nozzles suspending in a side-by-side relationship to each other from a reservoir holding a liquid to be infused, and a conveyor system beneath the nozzles to carry the vessels for transportation of the latter both in the horizontal and vertical directions. In the known liquid infusion apparatus, the conveyor system is adapted to transport empty vessels in the horizontal direction right beneath the nozzles and then ascend the same upwards to a level where the distal portions of the nozzles are positioned in the interiors of vessels. The infusion nozzles each include valve means which are actuated open by suitable means as the distal portions of the nozzles are present in the vessel interiors, which allows a liquid in the reservoir to thence flow by gravity into the vessels through the canals of nozzles. When a determined amount of liquid has been infused, the nozzle valves just mentioned are closed and the conveyor system operates to draw the nozzles out of the vessel interiors, thus completing the infusing operation.

In the known liquid infusion apparatus described above, any other propelling power than gravity is not applied to a liquid to be infused. This may be advantageous in the light of cost because hydraulic or pneumatic means for pressurizing the liquid reservoir are not present, but is disadvantageous in calling for a substantial length of time to pass the liquid through the nozzles. Provision of such hydraulic or pneumatic means as above mentioned is not practical in order to overcome the last mentioned disadvantage.

It is critical that air in the interiors of the vessels to be filled be relieved while the infusion operation is being performed. To this end, the infusion nozzle apparatus has an air relief conduit extending in an air space above the liquid level in the reservoir. The distal end opening of the relief conduit is located in or adjacent an outlet of the nozzle through which a liquid to be infused is poured out. Accordingly, a liquid to be infused is likely to enter and close the relief conduit, thus resulting in interrupting the infusion operation. This problem is particularly often encountered when any highly viscous liquid, such as, e.g., nectar, etc. is infused. Further, the liquid entering the relief conduit often carries dregs or any suspended solids into the relief conduit and the solids are gradually accumulated therein in the course of a number of or a substantial duration of infusion operation, until the relief conduit is thereby closed to a degree to adversely influence efficiency of the infusion operation or is entirely closed to interrupt the infusion operation. Accumulated solids have to be removed therefrom by a rinsing or cleaning operation for restoring of operation of infusion.

Cleaning or rinsing operation is further necessary when the nozzles are desired to be used for infusion of a different kind of liquid from that previously thereby infused. In this case, the cleaning or rinsing operation may be performed expeditiously in view of installation, by charging a rinsing medium in a reservoir and allowing the same to flow through the nozzles by the same procedures as the infusion operation. This, however, disadvantageously entails actuation of the valves in the nozzles which in turn is linked to elevation of the vessels or conveyor system beneath the nozzles, so that soiled solution from the rinsing operation is unavoidably received in the vessels on the conveyor. It is quite apparently disadvantageous that the rinsing medium is allowed to simply flow through the nozzles by gravitational force and accordingly at a low pressure, taking a long time period.

SUMMARY OF THE INVENTION

Accordingly, a first object of the invention is to provide a liquid infusion nozzle apparatus capable of spouting or force-infusion of a liquid, rather than spontaneous infusion thereof by gravitational force.

Specifically, there is provided according to one aspect of the invention a liquid infusion nozzle apparatus comprising an outer cylindrical wall member having the interior communicated with a reservoir and filled with a liquid to be infused, an inner cylindrical wall member coaxially arranged in the interior of the outer cylindrical wall member for axial movement therein, a valve member adapted to close communication between the interiors of the outer and the inner cylindrical wall members, and an air-relief conduit member supported on the outer wall member and extending through the outer and the inner wall members and the valve member to terminate as a distal end which is adapted to be inserted in a vessel to be infused with a liquid. When the vessel is elevated by suitable means, the inner wall member is thereby moved upwardly to compress air present in the inner wall member and below the closed valve member, increasing the inner air pressure of the inner wall member. As the inner wall member is further moved upwardly, the valve member is thereby opened to allow pressurized air to be upwardly bled out from the interior of the inner wall member into the liquid reservoir or be replaced by the liquid from the outer wall member. In other words, the liquid to be infused is allowed to gush with increased flow from the reservoir via the interior of the outer wall member into the interior of the inner wall member and the liquid runs downwardly therethrough by action of gravitational force in the direction toward the vessel.

Preferably, the inner volume of the inner wall member may be great enough to permit sufficient pressure to be established therein for force-infusing or spouting a determined amount of a liquid into a vessel.

Thus gush of the liquid into the vessel can expel air from the vessel interior via the relief conduit. The liquid received in the vessel at an accelerated rate can establish sufficient pressure to dispel any liquid present in the relief conduit having an upper open end through which such residual liquid can be returned into the reservoir.

There is provided according to the other aspect of the invention a method for force-infusion of a liquid to vessels, using the nozzle apparatus described in the foregoing.

A second object of the invention is to provide a liquid infusion nozzle apparatus capable of being cleaned or rinsed in an easy manner.

Specifically, there is provided according to a further aspect of the invention a liquid infusion nozzle apparatus of a similar arrangement as above stated, but further including means for retaining the inner wall member on the outer wall member when the inner wall member is elevated in a higher position than the same is raised for the normal operation of infusion. In order to render the liquid infusion nozzle apparatus ready for cleaning or rinsing operation, a rinsing medium is preliminarily charged in the reservoir and the inner wall member is manually raised to a higher position where the inner wall member is retained. The inner wall member in this raised position causes the inner air pressure to be raised and the valve member to be open as stated as regards the infusion operation, so that the rinsing medium is allowed to flow downwardly through the apparatus at an accelerated velocity for performing an efficient operation of cleaning or rinsing. A plurality of, or in almost all the cases, 6–12, nozzle apparatus can be rinsed simultaneously with the inner wall members of the respective apparatus being set in the position of retention, so that the conveyor system need not be actuated to raise any vessels and to maintain the same in the raised position where the valves are open.

A third object of the invention is to provide a liquid infusion nozzle apparatus in which a liquid to be infused is prevented from being directed toward the bore opening of the relief conduit while the liquid flows through the apparatus.

Specifically, the air-relief conduit member above referred to is provided adjacent the distal end with a pair of cross-sectionally cone-shaped, annular rib-like projections spaced axially from each other on the periphery, and the bore of the relief conduit is opened at a recessed portion defined between the pair of rib-like projections. The upper one of the cross-sectionally cone-shaped projections serves to radially spread a liquid flowing through the passage between the periphery of the relief conduit tube and the inner wall surface of the inner wall member immediately prior to entering the vessel interior. A liquid to be infused flowing through the annular passage between the periphery of the relief conduit tube and the inner wall surface of the inner wall member is radially spread by the upper one of the cross-sectionally cone-shaped projections and guided along the contour of the projections away from the opening of the relief conduit bore. This prevents liquid from choking the relief conduit which has caused interruption of the infusion operation or lowered the efficiency thereof in the prior art apparatus.

In a preferred embodiment of the invention, the relief conduit member has a bore opened laterally adjacent the distal end and an annular rib-like projection formed at the distal end, and a liquid outlet tubular member is arranged coaxially on the distal end portion of the relief conduit member at a small spacing, with the proximal portion tightly in contact with the inner surface of the inner wall cylindrical member, and with the distal portion secured to the annular projection of the relief conduit. The liquid outlet tubular member has an outlet opening immediately above the rib-like projection and in a lateral position diametrically opposed to the lateral opening of the relief conduit. A liquid to be infused passing through the outlet tubular member is spouted through the outlet opening and spread radially by means of the annular rib-like projection of the relief conduit member, and because of the outlet opening being opposed to the opening of the relief conduit, such a liquid spouted is prevented from reaching the vicinity of the opening of the relief conduit. In other words, a space where the liquid spreaded is absent is formed around the opening of the relief conduit, so that the opening of the relief conduit is protected from closure with the liquid spouted.

A fourth object of the invention is to provide a liquid infusion nozzle apparatus provided with means for positioning a vessel to be infused into correctly beneath the nozzle. Specifically, such means are constituted by a cylindrical guide mounted on the inner wall member and having a slide ring spring-urged and fitted therein, whereby a mouth of a vessel to be infused into is preliminarily received in the slide ring before the distal portion of the relief conduit tubular member is inserted through the vessel mouth. The slide ring thus serves to relocate the vessel into alignment with the nozzle apparatus if the vessel is not correctly in alignment therewith. Consequently, the distal portion of the relief conduit tubular member can be smoothly inserted into the vessel mouth, without damaging the inner wall surface of the vessel mouth.

Any other objects, aspects and characteristics of the invention will be apparent from the following description made as regards a preferred embodiment of the invention by reference to the accompanying drawings. The invention should, however, be not restricted to the described embodiment in any way, but should be construed as susceptible of any variations and modifications without departing the scope and the spirit of the invention.

BRIEF DESCRIPTION OF THE ACCOMPANYING DRAWINGS

DETAILED DESCRIPTION OF THE PREFERRED EMBOIDMENT

Figure 1:
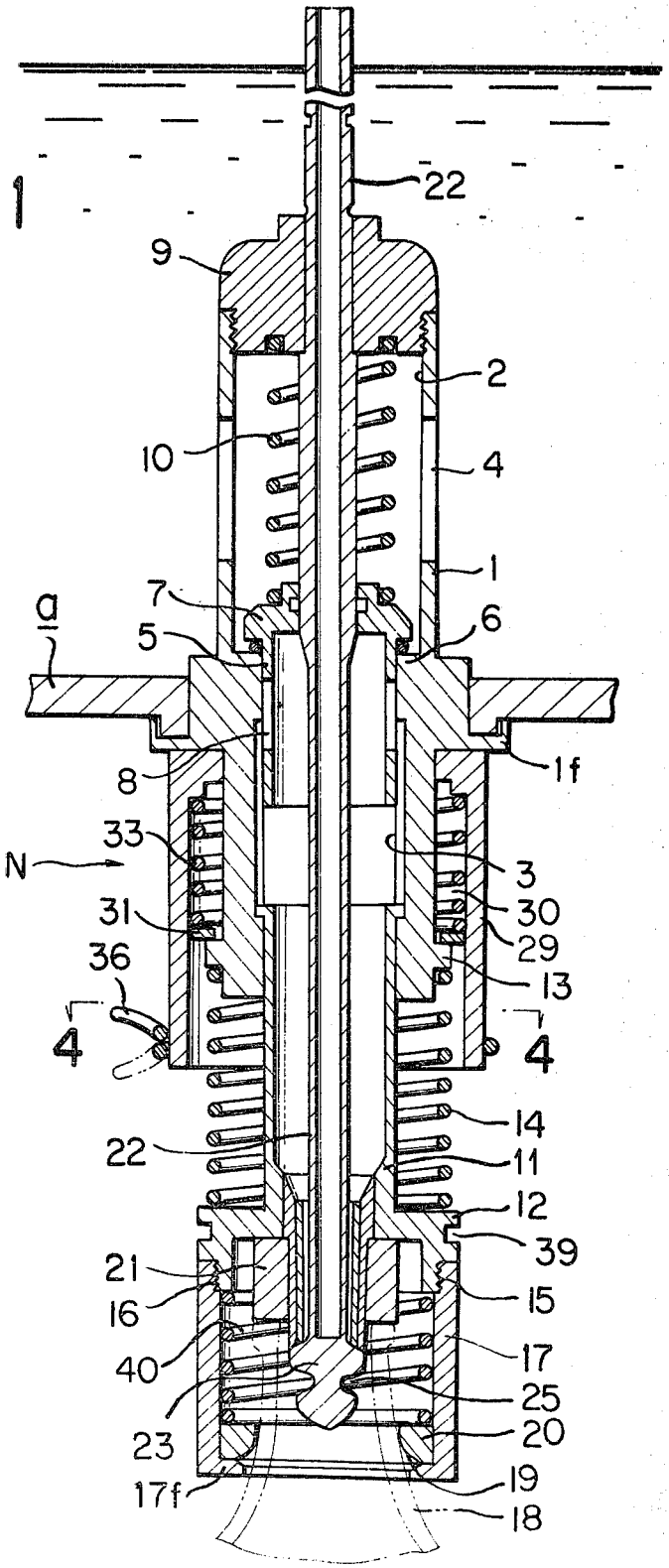
FIG. 1 is a longitudinal sectional view of a liquid nozzle apparatus embodied by the invention.

Referring now to FIG. 1, a nozzle apparatus is generally designated by N and comprises an outer cylindrical wall member 1 extending through a bottom wall portion of a reservoir a therein holding a liquid to be infused. The outer cylindrical wall member 1 has a nut-like flange 1*f* in the intermediary portion thereof, and the flange is threadedly secured to the bottom wall portion of the reservoir, so that the upper portion of the outer wall member is located within the reservoir while the lower portion thereof depends downwardly from the reservoir bottom wall portion. The upper and the lower portions of the outer wall member have different diameters, and the diameter of the upper portion is greater than that of the lower portion so that the outer wall member has great diameter and small diameter chambers 2 and 3 separated in the interior by an annular shoulder 6. The upper portion of the outer wall member is provided with a plurality of slot-like openings or windows 4 spaced from each other about the great diameter chamber 2 to communicate the interior of the reservoir with the great diameter chamber 2 into which a liquid to be infused held in the reservoir can thereby freely pass. There is a hollow cylindrical plunger 5 in the outer wall member. The plunger 5 has a flange-like valve portion 7 at the upper end and a cylindrical wall depending from the valve portion 7 and tightly, but movably fitted in the small diameter chamber 3, with valve portion 7 being adapted to ride on the upper surface of the shoulder 6. A coil spring 10 is interposed between the upper face of the flange-like valve portion of the cylindrical plunger 5 and an inner surface of an end plug 9 tightly and rigidly fitted in the upper end of the upper portion of the outer wall member, so as to urge the plunger downwardly with the flange-like valve portion 7 engaged with the annular shoulder 6, thereby preventing a liquid in the great diameter chamber from passing down into the small diameter chamber. In this closed position of the plunger 5, the depending cylindrical wall of the latter lies to extend downwardly from the shoulder 6, with its lower open end located remotely from the lower open end of the lower portion of the outer wall member. A plurality of slot-like openings or windows 8 are formed in the depending cylindrical wall of the plunger 5 to perform a function which will be hereinafter stated.

There is provided an inner cylindrical wall member 11 tightly, but slidably fitted in the lower open end portion of the outer wall member 1 and having an upper open end located in the small diameter chamber 3 in a spaced relationship with the lower end of the plunger 5 so that the inner cylindrical wall member 11 can be moved upwardly to abut against the lower end of the plunger 5. The inner wall member 11 has the lower end projecting from the lower end of the outer wall member 1 and is provided therein with a flange 12, and a coil spring 14 is interposed between the flange 12 and a suitable portion, say, a flange 13 in the lower portion of the outer wall member 1, thereby urging the inner wall member 11 in the downward direction. The flange 12 of the inner wall member 11 has a threaded circumferential surface 15 on which a cylindrical guide member 17 is threaded at an inner thread 16. The cylindrical guide member 17 has a length and a diameter which are corresponding to the mouth portion of a vessel to be received therein for liquid infusion, and accordingly may be replaced with a guide member having a different length and/or diameter for accommodating a dimensionally different mouth portion of a vessel. FIG. 1 shows a guide member which is adapted to receive a tapered mouth portion in a bottle 18 which is used as a vessel for wine, milk, mineral water or the like. The guide member 17 has an inner flange 17*f* around the inner circumference adjacent the distal end and a ring 20 slidably fitted therein to be urged downwardly against the inner flange by means of a spring. The ring 20 has an inner surface 19 shaped to have a diameter gradually reduced towards the upward direction, and adapted to abut conveniently against the sloped outer surface of the bottle mouth. The guide member may be made of rubber or plastic material. When the bottle is elevated, the rim of the bottle may abutt against the lower end face of the flange 12 of the inner wall member 11. A suitable adjuster ring 21 may be mounted in a known suitable manner on the lower end face of the flange 12 to compensate for any short mouth portion of a vessel or bottle.

Figure 2:
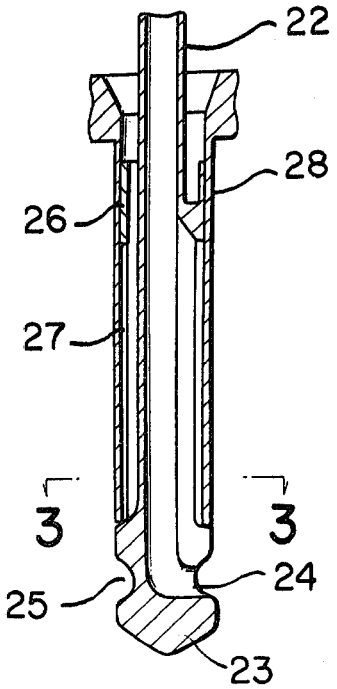
FIG. 2 is an enlarged view of the distal portion of the liquid nozzle apparatus, showing the lower end portion of the relief conduit.
Figure 3:
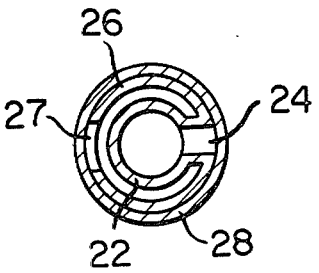
FIG. 3 is a cross-sectional view taken along line 3—3 of FIG. 2.
Figure 4:
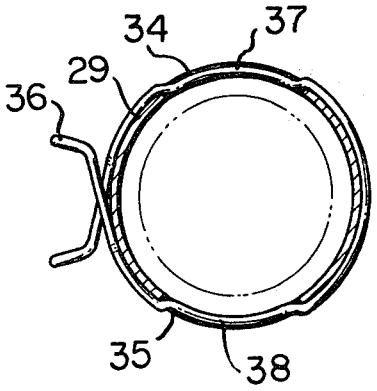
FIG. 4 is a cross-sectional view taken along line 4—4 of FIG. 1.

An air-relief conduit member 22 is supported by the end plug 9 of the outer wall member 1 and extends therethrough to have an upper open end located above the liquid level in the reservoir a. The interior of the conduit member 22 is thus communicated with the atmospheric air. The conduit member 22 also extends downwards coaxially through great diameter chamber 2, valve member 7, small diameter chamber 3, inner wall member 11, guide member 17 and ring 20 to have a distal end portion adapted to be located in the mouth portion of a bottle as the latter is elevated. The distal end portion of the air relief conduit member, as particularly shown in FIG. 2, has a pair of cross-sectionally cone-shaped annular rib-like projections 23 spaced axially from each other on the periphery and a slot-like opening 24 longitudinally extending in one lateral side wall and having at least the lowermost portion located in a recess 25 defined between the annular rib-like projections 23.

In the preferred embodiment, an outlet tubular member 26 may be disposed substantially coaxially around the distal portion of the air-relief conduit member 22, with the lower end secured or brazed on the upper surface of the upper one of the pair of rib-like projections 23, and with the upper end communicated with the interior of the outer wall member 11. The outlet tubular member 26 has a slot-like opening 27 extending longitudinally in the lateral wall portion diametrically opposed to the relief opening 24 of the conduit tubular member 22. The outlet tubular member 26 is tightly, but slidably fitted in a guide sleeve 28 which rigidly depends from the lower face of the inner wall member 11.

It is preferred that the distal portion of the air relief conduit member 22 be arranged in eccentricity with the outlet tubular member 26 with the outlet opening 27 formed in side wall so that one side portion of the periphery of the air-relief conduit is positioned in contact with that inner surface of the outlet tubular member which is opposed to the outlet opening 27. The contacting side portions of the air relief conduit member 22 and the outlet tubular member 26 are slotted to form the air relief opening.

An operating cylindrical member 29 is disposed around the lower portion of the outer wall member 1 and forms an annular space 30 relative to the outer wall member lower portion. The operating member 29 has a great enough diameter to accommodate the flange 12 of the inner cylindrical wall member 11 which is moved upwards, and its upper end is curved diametrically inwards to abut against the periphery of the outer wall member lower portion. An annulus 31 is provided on the inner wall surface of the operating member 29 apart from the curved upper end, and a coil spring 33 is interposed between the inner surface of the curved upper end and the upper surface of the annulus 31 to urge the operating cylindrical member 29 downwards, but the annulus 31 abuts against the upper surface of the flange 13 referred to hereinabove as provided in outer wall member lower portion, thus serving as a stopper of the operating member 29. The latter has adjacent the lower end a pair of slots 34 and 35 which are diametrically opposed to each other and extend along the circumferential direction. The slots 34 and 35 receive inwardly recessed portions 37 and 38 of a looped elastic wire fitting 36 surrounding the periphery of the operating cylindrical member 29 and having opposed end portions knotted or crosswisely engaged with each other to maintain the annular shape against elastic restoration force to linearity. The inwardly recessed portions of the wire fittings received in the slots 34 and 35 projects from the inner surface of the operating member 29. The flange 12 of the inner wall member 11 has an annular groove 39 in the outer circumferential surface thereof, and when the inner wall member 11 is manually raised to a sufficient level, the annular groove in the flange 12 of the inner wall member 11 is engaged elastically by the inwardly recessed portions of the elastic wire fitting 36. At this time, the valve member 7 gets in an open position by means of the raised inner wall member 11.

The foregoing explanation has been made about only one nozzle apparatus embodied by the invention, but in practice, a plurality of such nozzle apparatus are arranged in a row to suspend from the liquid reservoir a.

The liquid reservoir is filled with a liquid to be infused into a suitable vessel or receptacle 18, and is present in the great diameter chamber 2 because of the outer wall member 1 having openings or windows 4. The liquid is prevented from running downwards through the outer wall member by means of the valve member 7 being urged in contact with the shoulder 6 of the outer wall member by action of the spring 10. Although not shown, there is provided beneath a row of the nozzle apparatus, a conveyor system which can be successively loaded with a row of spaced vessels and operate to transport the same not only in a horizontal, but a vertical direction toward and away from the location of the nozzle apparatus. When the conveyor system has transported the vessels to a position right beneath the nozzle apparatus, the system has a platen with the vessels thereon elevated by suitable means so that the mouths of the vessels enter the cylindrical guides of the nozzle apparatus. The drawing shows the mouth of one of such vessels in phantom. The ring 20 in the guide 17 gets in contact with the shoulder of the mouth of vessel at the tapered portion 19 thereof. Because of action of the spring 40 exerted on the ring 20, the axis of the vessel can be force adjusted correctly into alignment with that of the nozzle apparatus if the vessel axis is not originally so. As the vessel is elevated further, the distal end portion of the air-relief conduit member 22 enters the vessel at the mouth, with the brim of the vessel acting to move the inner wall member 11 by the intermediary of adjuster ring 21 against the action of the spring 14, so that the air space of the small diameter chamber 3 of the outer wall member 1, and the interiors of the plunger 5 and the inner wall member are reduced to gradually increase an inner air pressure as the inner wall member 11 moves upwards, which increased pressure should be great enough to effectively help force injection of the liquid with a great moment into the inner wall member. Such a pressure rise has been attained when the upper end of the inner wall member 11 abutts against the plunger 5 and moves the latter upwards against force of spring 10. This causes the valve member 7 to be disengaged from the shoulder of the outer wall member 1, and the valve member or the plunger is raised to a position that the openings 8 are located in the great diameter chamber of the outer wall member. In this position of the plunger member the liquid in the great diameter chamber 2 is allowed to gush through the openings 8 in the plunger, inner wall member and the outlet tubular member 26, replacing the inner air compressed in the above stated manner. The guide sleeve 28 suspended from the inner wall member is elevated so that the outlet opening 27 becomes open to allow the liquid to flow from the outlet tubular member 26 and impinge on the upper surface of the cross-sectionally conical projection 23, thereby spreading the liquid in a radial direction into the interior of the vessel.

Air in the vessel is communicated through the opening 24 of the air-relief conduit 22 and the interior of the latter, and relieved to the upper air space in the reservoir a. It is apparent that air replaced by the liquid spouted into the vessel and flowing out of the latter has a sufficient pressure to move upwards any liquid remaining in the air-relief conduit and expel the same therefrom for returning into the reservoir a. The liquid outlet opening 27 is located oppositely to the air-relief opening 24, thus effectively preventing the spouted liquid from entering the air-relief conduit 22, resulting in failure of air relief and accordingly interruption of the infusion operation.

When a determined amount of the liquid has been infused into the vessel, the conveyor system is responsively lowered so that the spring 14 may effect lowering of the inner wall member 11 to the initial position. The plunger 5 is released from the inner wall member 11 and is free to be urged by action of the spring 10 to abut against the shoulder 6, which prevents inflow of the liquid downwards into the inner wall member 11. The conveyor system then operates to transport the vessels away from the nozzle apparatus in the horizontal direction and a new row of empty vessels right beneath the nozzle apparatus for the successive operation of infusion.

In case that the nozzle apparatus is desired to be rinsed, the guide member 17 may be manually elevated after a rinsing medium has been charged in the reservoir a. The valve member 7 is thereby disengaged from the shoulder 6 of the outer wall member in a similar manner as hereinabove described in connection of infusion operation of a liquid into vessels, thus permitting a rinsing medium to force-run or spout through the inner wall member 11. When the guide member 17 is further upwards moved until the flange 12 of inner wall member is received in the space 30 in the operating member 29, the inwardly recessed portions 37 and 38 of wire fitting 36 in the openings 34 and 35 of the operating member can be engaged with the annular groove 39 in the flange 12 of inner wall member 11 (if necessary, the operating member 29 is manually held against upward movement at that time), so that the inner wall member and guide member 17 are retained in the raised position that the rinsing medium is kept to spout via valve member 7 through the nozzle apparatus which is thereby rinsed. When spout of the rinsing medium or solution is discontinued, the inwardly recessed portions 37 and 38 of wire fitting 36 can be elastically displaced further inwards by manually applying a pressure to the knotted end portions of the wire held between the thumb and the finger, thus permitting the recessed portions 37 and 38 to be disengaged from the annular groove 39 and thus the spring 14 to act to urge the valve member, plunger and inner wall member to be restored in the original closed position. The elastic wire fitting 36 for holding the inner wall member and the guide member in a raised position, thus permits a plurality of the nozzle apparatus to be rinsed simultaneously with the valve members in the open position.

While this invention has been described in detail with only one certain embodiment thereof, it will be apparent that this application is intended to cover any such modifications thereof as may fall within the scope of one skilled in the art, or the appended claims.

What is claimed is:

1. A nozzle apparatus for infusing a liquid from a liquid reservoir into a vessel, said vessel being located below said liquid reservoir, comprising an outer wall cylindrical member secured to the bottom of said reservoir providing a first chamber separate from said reservoir adapted to be filled with a liquid held in said reservoir, an inner wall cylindrical member fitted in said outer wall cylindrical member for axial movement therein providing a second chamber, valve means between said first and second chambers and adapted to connect and disconnect between said first and second chambers, air-relief conduit means rigidly carried by said outer wall cylindrical member and extending through said outer wall cylindrical member, said valve means and said inner wall member, the distal portion of said air-relief conduit means being adapted to be received in a vessel for said liquid to be infused into, elevation of said vessel causing said inner wall cylindrical member to be moved upwards to first compress air present in said second chamber and thereafter allow said valve to connect between said first and second chambers for infusion of liquid from said reservoir into said vessel and means for retaining said inner wall cylindrical member in a higher position than said position allowing said valve to connect between said first and second chambers.

2. The nozzle apparatus defined in claim 1 wherein said air-relief conduit means have a pair of cross-sectionally conical annular rib-like projections spaced from each other on the periphery of the distal portion to define a recess therebetween, and an opening located at least in said recess.

3. The nozzle apparatus defined in claim 1 and further including a liquid outlet tube coaxially spaced from the periphery of said distal portion of said air-relief conduit means, said distal portion of said air-relief conduit means having an opening in one lateral wall and an annular rib-like projection on the periphery, said liquid outlet tube having an upper open end tightly connected with the inner wall of said inner wall cylindrical member and a distal end connected with said rib-like projection, a liquid outlet opening being located in said outlet tube oppositely to said opening of said air-relief conduit means.

4. The nozzle apparatus defined in claim 3 and further including a replaceable cylindrical guide member for a vessel disposed at the lower portion of said inner wall cylindrical member and having a slide ring therein urged by spring means in the downward direction, whereby the mouth of a vessel can be received in the opening of said ring for shifting the vessel into alignment with the nozzle apparatus.

5. A method for infusing a liquid from a liquid reservoir into a vessel, said vessel being located below said liquid reservoir, using a nozzle apparatus comprising an outer wall cylindrical member secured to the bottom of said reservoir and adapted to be filled with a liquid held in said reservoir, an inner wall cylindrical member fitted in said outer wall cylindrical member for axial movement therein, valve means in one of said inner and said outer wall cylindrical members and adapted to connect and disconnect between said inner and said outer wall members, and air-relief conduit means rigidly carried by said outer wall cylindrical member and extending through said outer wall cylindrical member, said valve means and said inner wall member, said method comprising charging a liquid into a reservoir with said valve means positioned to disconnect between said inner and said outer wall cylindrical members to allow said liquid to enter said outer wall cylindrical member, and elevating a vessel toward said nozzle apparatus to move upwards said inner wall cylindrical member to increase an air pressure in said inner wall cylindrical member until said inner wall cylindrical member reaches a position allowing said valve member to connect between said inner and said outer wall cylindrical members, whereby said liquid is gushed into said inner wall cylindrical member.

* * * * *